US007377076B2

(12) United States Patent
Shedd

(10) Patent No.: US 7,377,076 B2
(45) Date of Patent: May 27, 2008

(54) SINGLE-ACTION EGRESS LOCK FOR A SLIDING DOOR

(75) Inventor: Nathaniel S. Shedd, Calgary (CA)

(73) Assignee: Haworth, Ltd., Calgary, Alberta (CA)

( * ) Notice: Subject to any disclaimer, the term of this patent is extended or adjusted under 35 U.S.C. 154(b) by 415 days.

(21) Appl. No.: 10/966,344

(22) Filed: Oct. 15, 2004

(65) Prior Publication Data

US 2006/0080912 A1 Apr. 20, 2006

(51) Int. Cl.
*E05B 55/00* (2006.01)

(52) U.S. Cl. ..... 49/449; 70/108; 70/129; 70/130; 70/134; 292/162; 292/163

(58) Field of Classification Search ..... 70/103, 70/108, 113, 116, 124, 129, 130, 134, 150, 70/467, 469, 474, 95, 99, 100; 292/38, 42, 292/137, 160, 162, 163, 172, 175, 171; 49/449
See application file for complete search history.

(56) References Cited

U.S. PATENT DOCUMENTS 1,940,971 A * 12/1933 Schwartz et al. ..... 292/164
2,212,707 A * 8/1940 Daum ..... 70/150
2,969,666 A * 1/1961 Muessel ..... 70/116
4,154,070 A * 5/1979 Bahry et al. ..... 70/108
4,691,543 A * 9/1987 Watts ..... 70/143
4,962,653 A * 10/1990 Kaup ..... 70/107
5,290,077 A * 3/1994 Fleming ..... 292/35
5,495,731 A * 3/1996 Riznik ..... 70/108
5,561,994 A * 10/1996 Smith et al. ..... 70/99
5,896,763 A * 4/1999 Dinkelborg et al. ..... 70/93
6,050,115 A * 4/2000 Schroter et al. ..... 70/107
6,209,931 B1 * 4/2001 Von Stoutenborough et al. 292/160
6,289,704 B1 * 9/2001 Collet et al. ..... 70/107
7,013,687 B2 * 3/2006 Shedd et al. ..... 70/99
7,032,417 B2 * 4/2006 Toulis et al. ..... 70/97
2002/0104339 A1 * 8/2002 Saner ..... 70/108
2005/0144848 A1 * 7/2005 Harger et al. ..... 49/449

* cited by examiner

*Primary Examiner*—Gregory J. Strimbu
(74) *Attorney, Agent, or Firm*—Flynn, Thiel, Boutell & Tanis, P.C.

(57) ABSTRACT

A handle-latch assembly mounted on a horizontal sliding door and coupled to a vertically movable latch bolt which protrudes outwardly from a top or bottom door edge, and which enables the inside and outside handles of the door to be respectively used for moving the door in closing and opening directions. The door has a manual lock actuator on the inside of the door, and an optional key-lock actuator on the outside of the door, whereby latching the door in the closed position requires a deliberate manual manipulation of either the inner lock actuator or the outer key actuator. The assembly permits sequential unlocking and opening of the door from the inside by application of a single horizontally-directed force to the inner handle. The handle-latch mechanism includes cooperating linkages, and the linkages are automatically reset into an unlocked position whenever the locked door is opened from the inside.

9 Claims, 8 Drawing Sheets

SINGLE-ACTION EGRESS LOCK FOR A SLIDING DOOR

FIELD OF THE INVENTION

This invention relates to a horizontal sliding door having a vertically retractable latch bolt associated therewith and, more specifically, to an improved handle-lock assembly associated with the door and connected to the latch bolt to enable the sliding door to be manually unlocked and slidingly moved into an open position by application of a manually-applied single-directed force and motion to the handle to facilitate egress through the doorway.

BACKGROUND OF THE INVENTION

Sliding doors supported solely for substantially horizontal sliding movement are conventionally utilized within building interiors, such as office buildings, to separate various areas of the building. Such sliding doors are particularly desirable in commercial environments since the door does not protrude into adjacent hallways or workspaces, and hence permits more efficient utilization of adjacent spaces. A disadvantage associated with such sliding doors, however, is encountered when locking of the door, such as for privacy purposes, is desired. The force and motion required for opening and closing a sliding door is horizontally directed, in contrast to the typical rotary force and motion utilized with door handles mounted on swinging doors. When it is desired to permit selective locking of a sliding door for privacy purposes, the door is typically provided with a separate mechanism which requires separate manual manipulations. This is further complicated when the sliding door is provided with a latching bolt which moves vertically and protrudes outwardly from an upper or lower edge of the door, although this latter type of latching bolt is typically preferred since it provides greater flexibility in most use environments.

Pending U.S. application Ser. No. 10/424,260 illustrates therein a handle-latch assembly for a horizontal sliding door which addresses the above concerns by permitting sequential unlocking and opening of a horizontal sliding door by application of a single-direction force and motion to the door handle to facilitate egress. While the mechanism disclosed in this application represents a desirable approach with respect to improving on latching arrangements for sliding doors, nevertheless the aforementioned mechanism is not believed to provide a comprehensive overall solution, and the present invention is believed to provide additional improvements with respect thereto.

More specifically, this invention relates to an improved handle-latch assembly which mounts on a horizontal sliding door and couples to a vertically movable latch bolt which protrudes outwardly from one of the top or bottom edges of the door, and which enables the inside and outside handles of the door to be respectively used for moving the door in closing and opening directions, with the door also having a manual lock actuator on the inside of the door and an optional key-lock actuator on the outside of the door, whereby latching of the door in the closed position requires a deliberate manual manipulation of either the inner lock actuator or the outer key actuator. The mechanism, however, permits sequential unlocking and opening of the door from the inside thereof solely by application of a generally single horizontally-directed force to the inner handle, whereas when the door is in the closed and latched position it can be opened from the outside thereof only by first manually releasing the lock through utilization of the separate key actuator. The handle-latch mechanism includes cooperating linkages which facilitate the above functions, and which ensure that these linkages and specifically the locking linkage is automatically reset into its unlocked position whenever the locked door is opened from the inside thereof due to manipulation of the inner handle.

Other objects and purposes of the invention will be apparent to persons familiar with constructions of this general type upon reading the following specification and inspecting the accompanying drawings.

Figure 1:
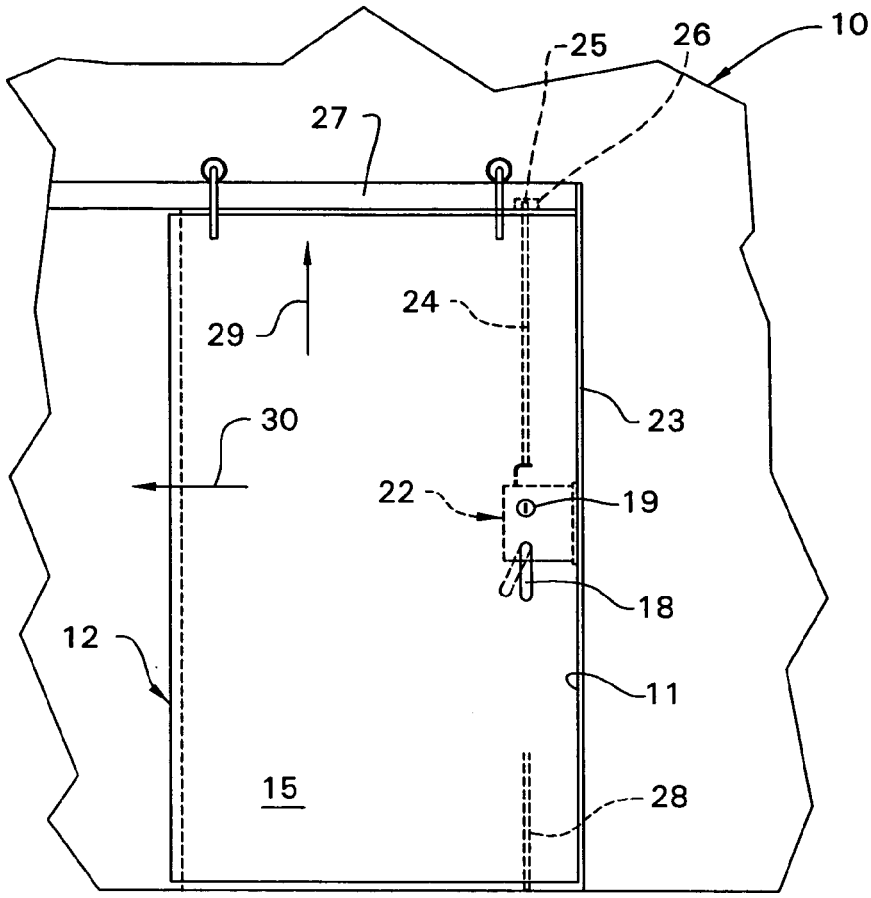
FIG. 1 is a diagrammatic elevational view showing a wall having a door opening therein and having a horizontally sliding door disposed for closing the opening, the door being in the closed position and shown from the outside surface thereof.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the door or designated parts of the door handle and locking mechanism. The words "inside" and "outside" will refer to opposite sides of the door, although it will be appreciated that these terms as they are used in relationship to the invention and its orientation with respect to the door can obviously be reversed. Said terminology will include the words specifically mentioned, derivatives thereof, and words of similar import.

DETAILED DESCRIPTION

Figure 2:
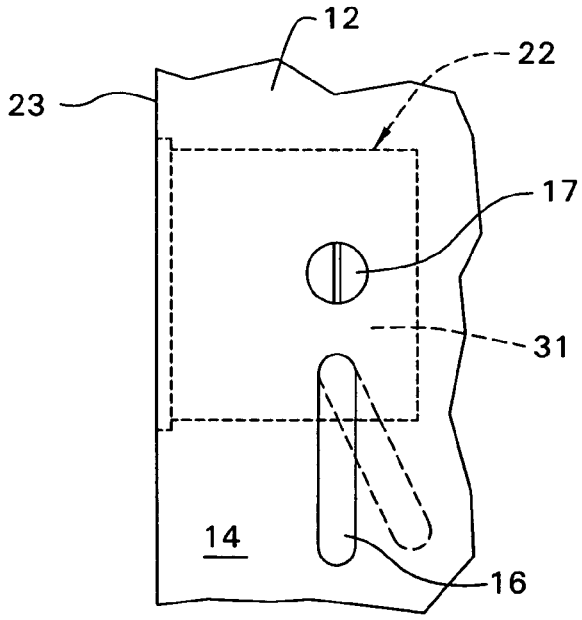
FIG. 2 is an enlarged fragmentary view which illustrates the handle and lock mechanism provided on the other or inner side of the sliding door shown in FIG. 1.

Referring to FIGS. 1 and 2, there is diagrammatically illustrated an upright wall structure 10 having a doorway or access opening 11 therein, such as for providing communication between an office or workspace on one side of the doorway, and a corridor or other region on the other side of the doorway. An upright sliding door 12 is disposed for horizontal sliding movement adjacent the wall structure 10 so as to be movable between open and closed positions relative to the doorway 11. The door 12 in FIG. 1 is illustrated in a closed position wherein it extends across the doorway.

The sliding door 12, as is conventional, is supported in the illustrated arrangement on a support track 27 which is stationarily supported and extends horizontally along one of the upper or lower edges of the sliding door, the track 27 in the illustrated embodiment being disposed adjacent the upper edge of the door so as to permit the door to be movably supported on and suspended from the track, such as by rollers, as is conventional. The door projects upwardly from and has a lower edge thereof in close proximity to a horizontal surface such as a floor.

According to the present invention, the sliding door 12 has a first handle 16 mounted on the door adjacent a first or inside surface 14 thereof. The handle 16 is preferably defined by a vertically elongate actuating lever which is oriented so as to always be dominantly vertically oriented, with the handle lever having a substantial length, such as at least several inches in length. The handle 16 is preferably supported at one end thereof, such as the upper end in the illustrated embodiment, for swinging movement relative to the sliding door about a substantially horizontal pivot axis which transversely intersects the door. The handle 16 due to its cooperation with a latching arrangement or mechanism 22 provided interiorly of the door, is limited for vertical swinging movement through only a small arcuate extent, as discussed hereinafter.

The sliding door 12 also preferably mounts thereon an outer handle or grip 18 which is disposed adjacent the other or outer surface 15 of the sliding door. The outer handle 18 in the illustrated embodiment is also a vertically elongate lever which is pivotally supported adjacent one end, the upper end in the illustrated embodiment, although it will be appreciated that other variations of the outer handle 18 can be provided.

The inner handle 16 is positioned in close proximity to but is independent of a rotatable thumb turn 17 which is manually accessible adjacent the inside surface 14 of the door, and in similar fashion a key-activated lock cylinder 19 having a key-accessible slot 21 is associated with the outside surface 15 of the door in the vicinity of the outer handle 18. The manually accessible thumb turn 17, and the manually accessible key cylinder 19, both cooperate with the latching arrangement 22 as described hereinafter.

The latching arrangement 22 is associated with and protrudes inwardly from one of the upright edges 23 of the sliding door, namely the leading edge of the door when the door is moving in a closing direction. The latching arrangement 22 connects to and controls the movement and position of an elongate latch bolt 24 which moves and projects vertically of the door and, in the illustrated embodiment, projects upwardly and has an end part 25 which protrudes outwardly beyond the top edge of the door for engagement with a retainer 26 which is fixed to the header or track 27 when the latch bolt 24 is in its latching (i.e. locking) position. The door 12 can also be provided with a downwardly-projecting latch bolt 28 which can be vertically displaced for engaging a floor or threshold, if desired. Such additional latch bolt 28 would be controlled by the latching arrangement 22 and simultaneously activated with the upper latch bolt 24.

In the present invention and as diagrammatically illustrated by FIG. 1, the upper latch bolt 24 is moved vertically upwardly into a latching or locked position, as indicated by the arrow 29, and the door 12 is moved horizontally in an opening direction, as indicated by the arrow 30.

Figure 3:
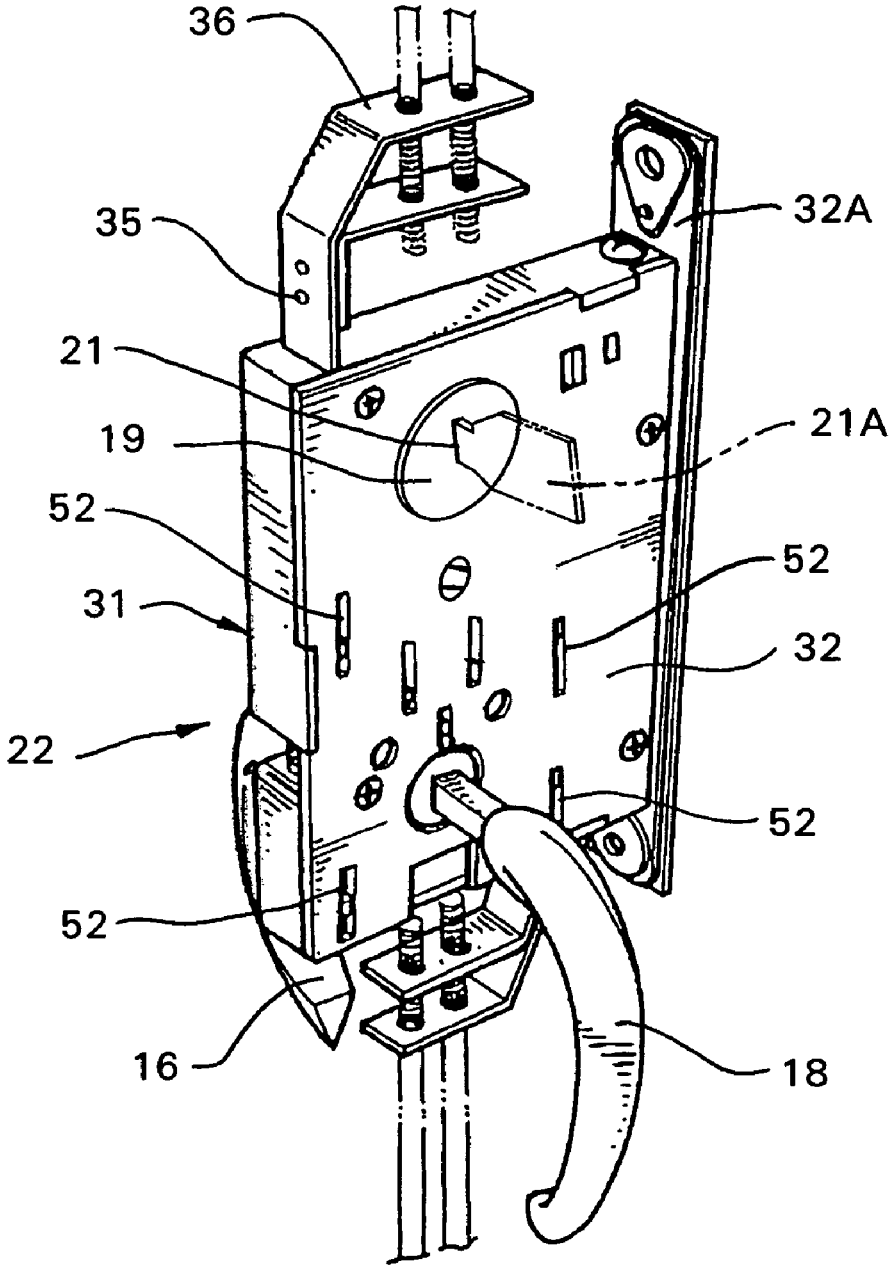
FIG. 3 is a perspective view which illustrates the handle-latch mechanism shown generally from the outside thereof and shown separated from the door.
Figure 4:
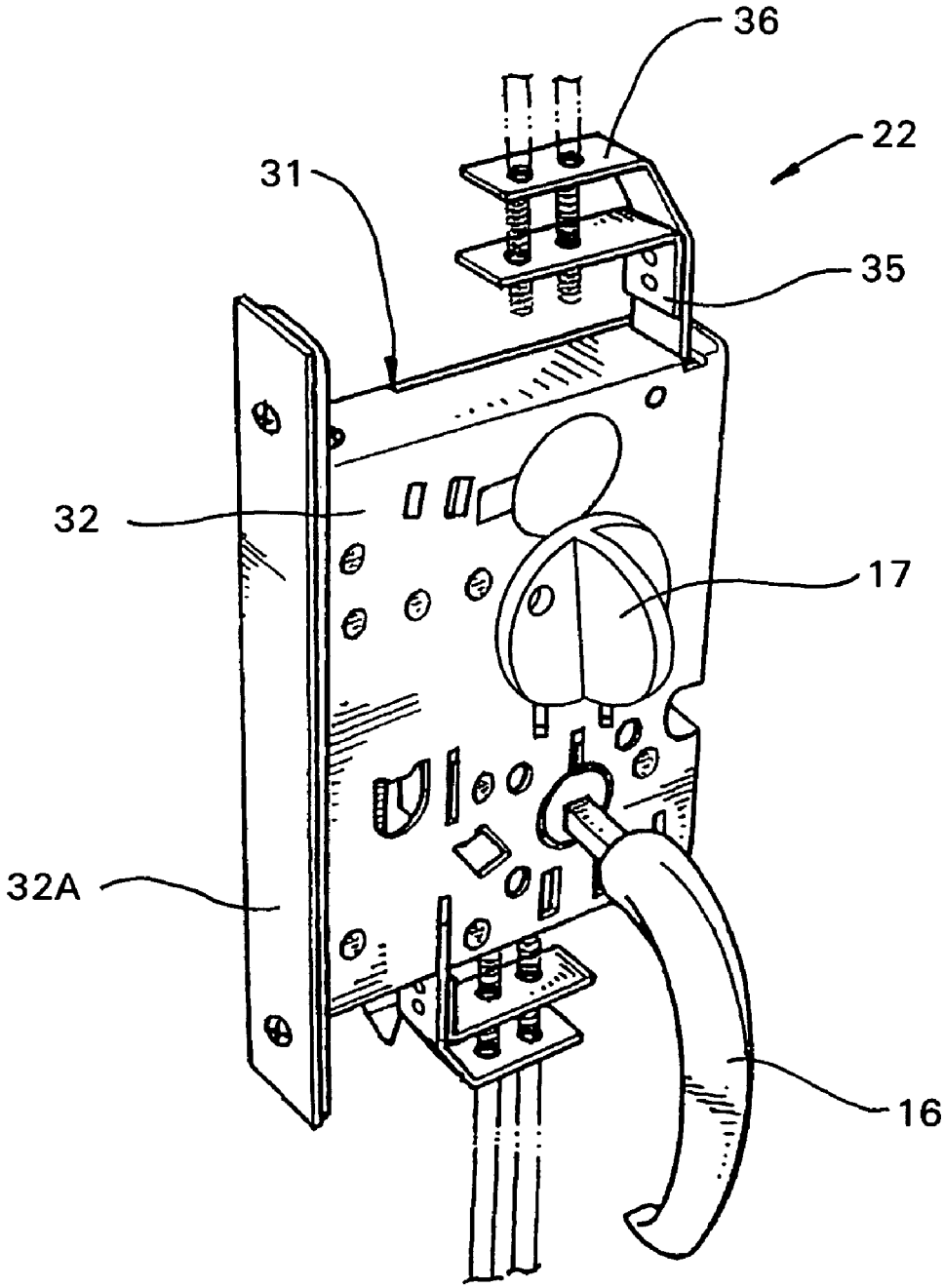
FIG. 4 is a perspective view showing the opposite or inside surface of the handle-latch mechanism of FIG. 3.

The latching arrangement 22, as shown in FIG. 3-4, is enclosed generally within a small closed boxlike housing 31 which has generally opposed and generally parallel vertical side walls 32 spaced a small distance apart so that the boxlike housing 31 can be disposed interiorly of the door 12, with the housing having an edge wall 32A which is positioned substantially flush with the upright door edge 23, such being conventional.

Figure 5:
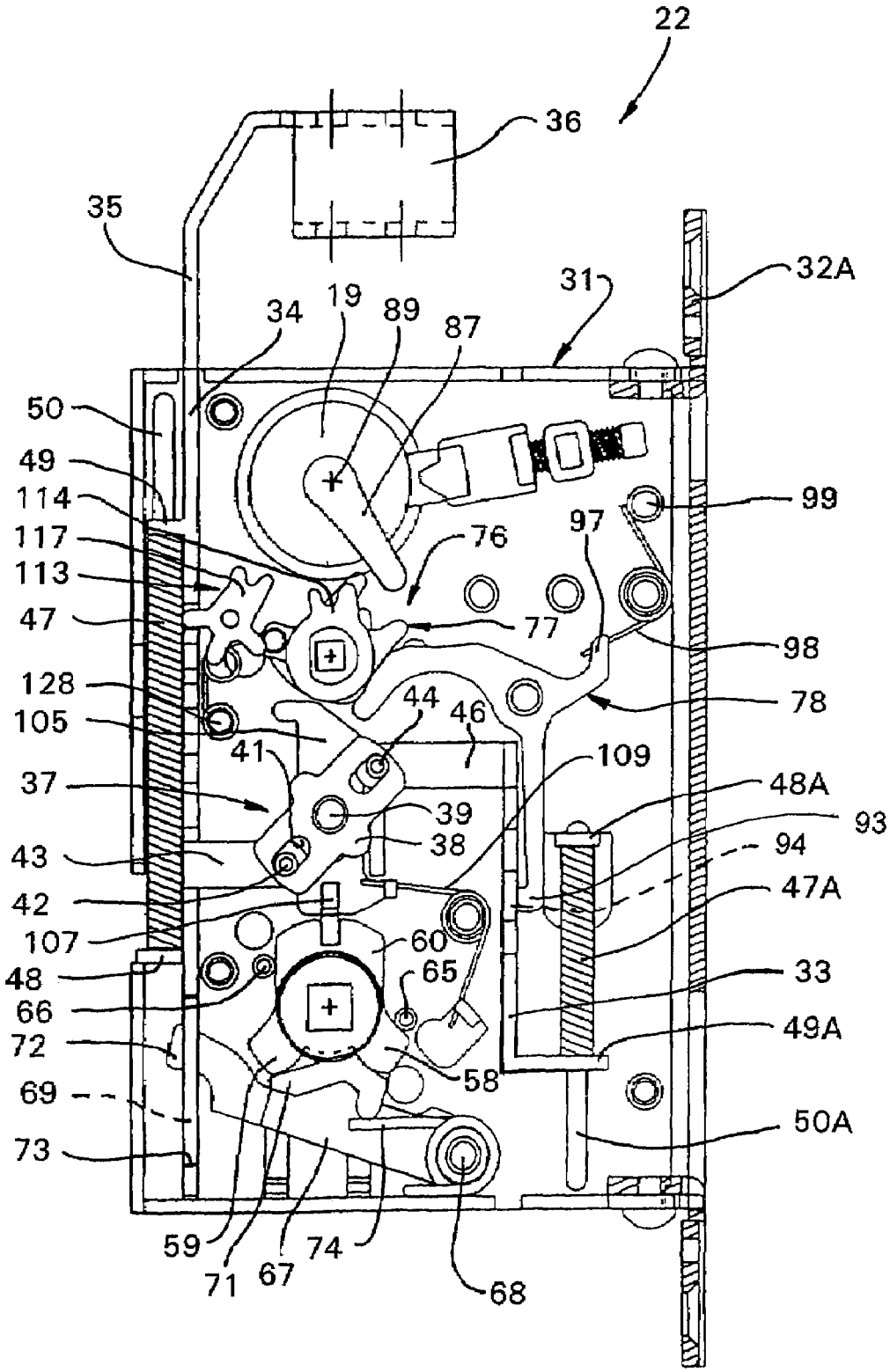
FIG. 5 is a front elevational view of the mechanism shown in FIG. 3, the front wall of the housing being removed, and the mechanism being shown in the unlatched position of the door.
Figure 6:
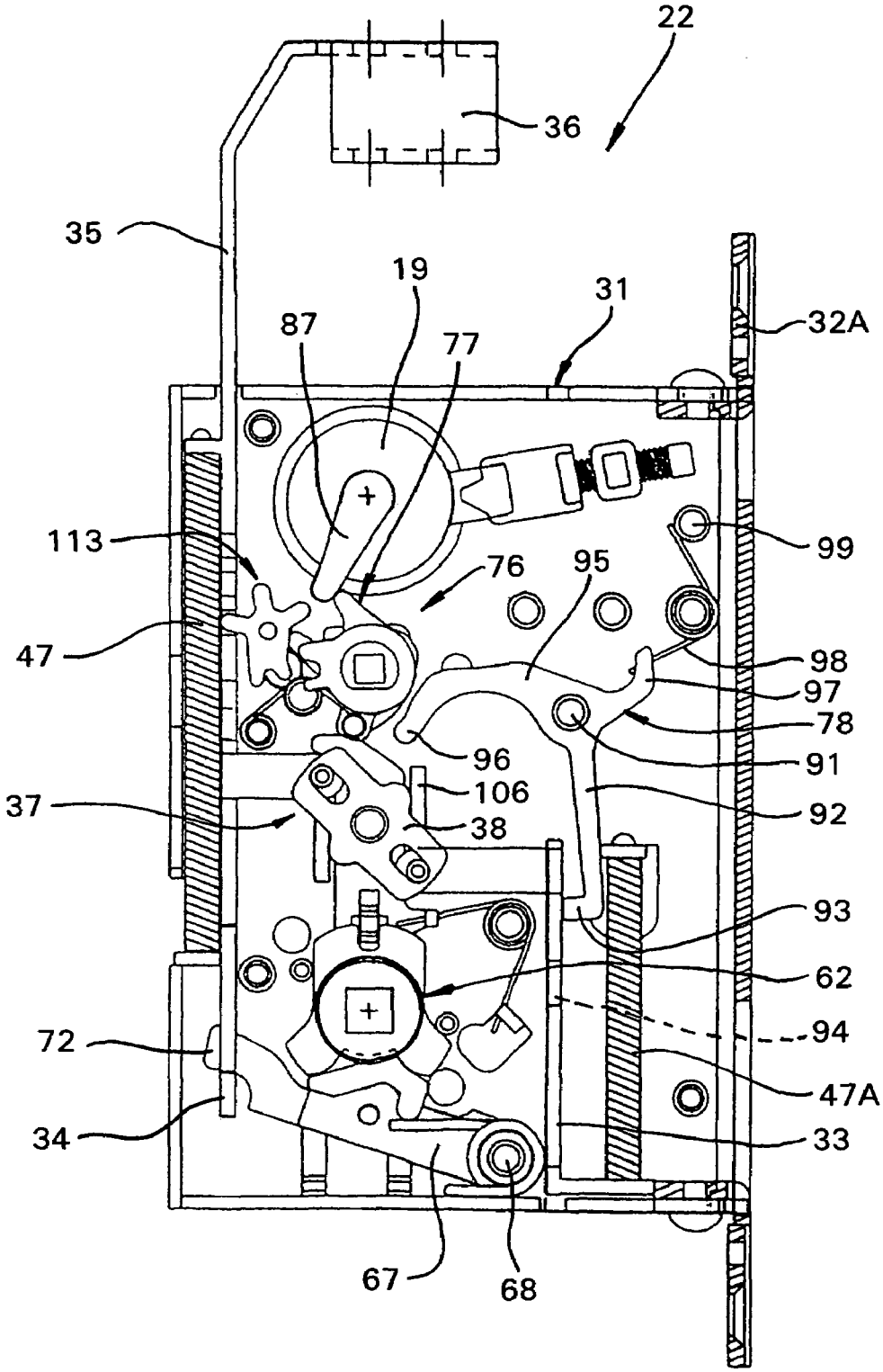
FIG. 6 is a view which corresponds to FIG. 5 but shows the mechanism corresponding to the latched position of the door.

The latching arrangement 22, as illustrated by FIGS. 5-6, includes a pair of vertically-elongate platelike slide or control members 33 and 34 disposed within the housing in generally parallel relationship, and supported for generally vertical slidable displacement. The control or slide member 34 is positioned adjacent the rear edge wall of the housing 31 and includes an upper extension 35 which projects through the top wall of the housing. Extension 35 mounts thereon an attachment bracket 36 to which the vertically extending top latch bolt 24 is secured.

The parallel slide members 33 and 34 are movably interconnected through a control mechanism 37 which provides that slides 33 and 34 always move synchronously but in opposite vertical directions. This control mechanism 37 includes a control lever 38 centrally supported on a pivot axle 39 which is supported on the housing and defines a generally horizontal pivot axis extending transversely relative to the door. The control lever 38 has elongated slots 41 which project radially outwardly from opposite sides of the pivot 39 in generally aligned relation, which slots respectively slidably receive therein guide pins 42 and 44 respectively. The pin 42 is carried on a lug or projection 43 which is fixed to and projects sidewardly from the slide member 34, and in similar fashion the other pin 44 is carried on a lug or projection 46 which is fixed to and projects sidewardly from the other slide member 33.

The slide member 34, and the upper latching bolt 24 carried thereon, are normally urged vertically upwardly toward a latching (i.e. locking) position by means of an elongate coil spring 47 which has the lower end thereof seated against a tab 48 fixed to the housing 22, and the upper end of spring 47 bears against a tab 49 which is fixed to the slide member 34. An elongate guide rod 50 has its lower end fixed to the tab 48 and projects coaxially through the spring 47 for guiding purposes. The spring 47 hence always exerts a force against the tab 49 tending to urge the slide member 34 and the bolt 24 in an upward (i.e. a latching) direction.

A further spring 47A reacts at one end against a fixed housing tab 48A, and at the other end, against a further tab 49A fixed to the other slide member 33, whereby spring 47A always exerts a biasing force urging the slide member 33 in a downward direction. The springs 47 and 47A, acting through the control mechanism 37, hence always exert a force tending to urge the bolt 24 towards its upper latching position, (as shown in FIG. 6).

Figure 9:
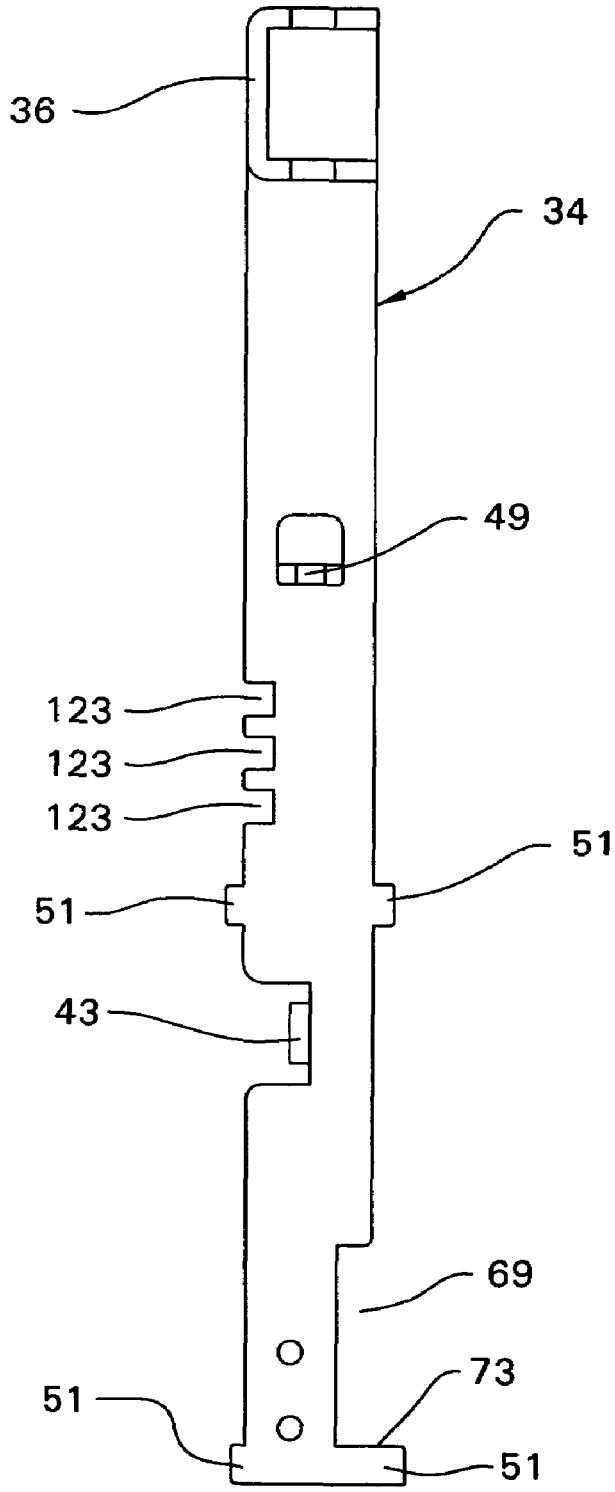
FIG. 9 is an enlarged side view of the vertical slide which couples to the latch bolt.

It will be appreciated that, in situations where the door is provided with a bottom latching bolt 28 (FIG. 1) to either supplement or replace the top latching bolt 24, then in such instance the slide 33 will be provided with an extension which protrudes downwardly through the bottom wall of the housing 31, similar to the upper extension 35, for attachment to the bottom latching bolt. The vertical sliding of the slide members 33 and 34 within the housing 31 can be controlled by any suitable construction and, in the illustrated embodiment, the slides 33 and 34 can be provided with lugs or stops 51 (FIG. 9) protruding from one or both sides thereof, the lugs being suitably guided within elongate slots 52 (FIGS. 3 and 4) formed in the side walls 32 of the housing 31 to support and slidably guide the slide members. These slots can also be utilized to define end stops for defining the motion limits of the slide members.

Figure 7:
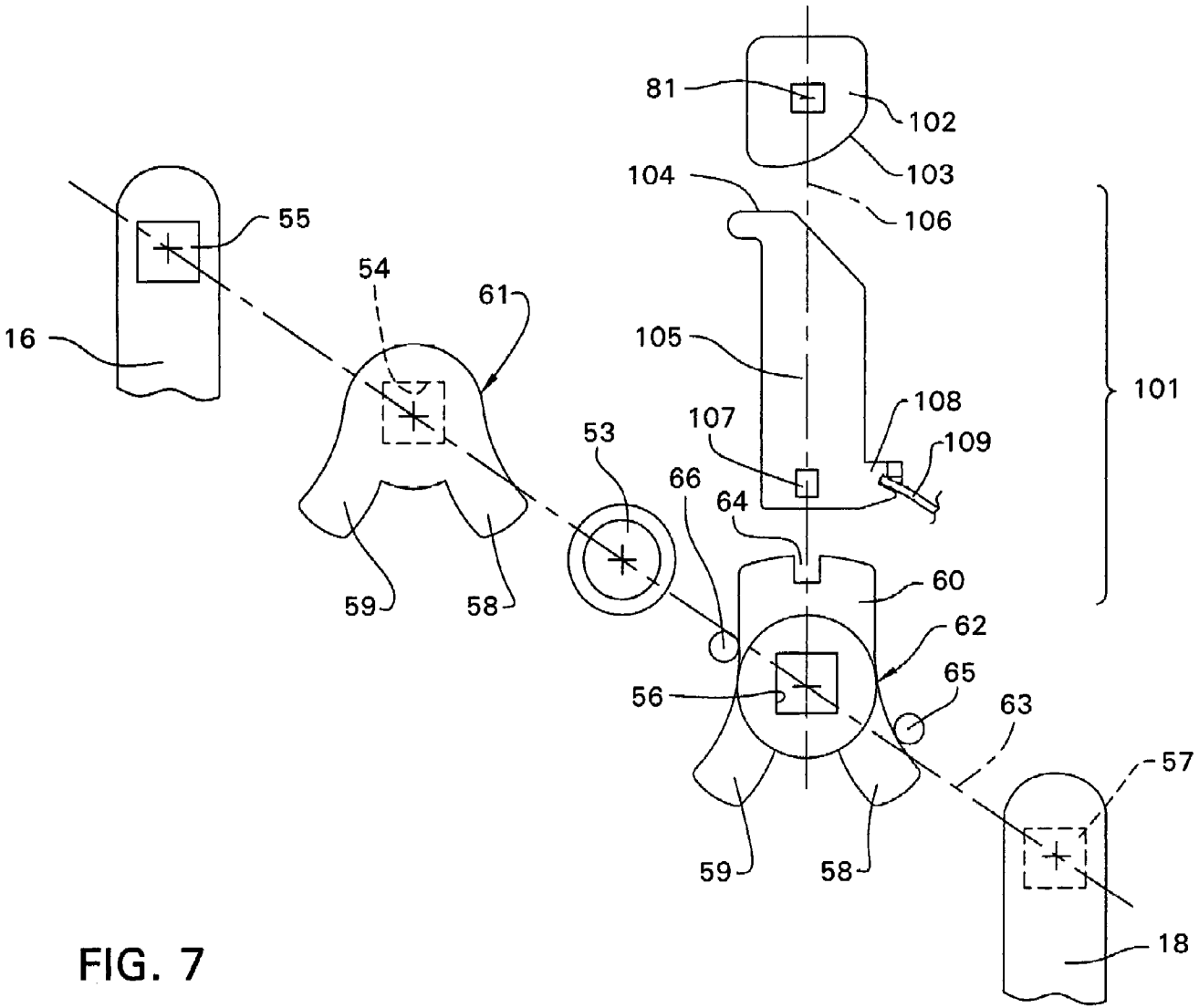
FIG. 7 is an exploded diagrammatic view which illustrates the manner in which inside and outside handles couple to rotary actuators, and the cooperation of the lock mechanism with the rotary actuator of the outer handle.

As illustrated by FIGS. 5-7, the latching arrangement 22 includes a pair of coaxially aligned but independently rotatable hubs 61 and 62 which are coaxially aligned and rotatable about a horizontal axis 63 which extends transversely of the door. These rotatable hubs 61 and 62 are separated by a washer member 53 therebetween so as to permit independent rotation thereof. The rotary hub 61 cooperates with the inside handle 16, and for this purpose has a generally non-circular (i.e. square) recess 54 opening coaxially thereof for accommodating therein the generally square drive hub 55 provided on the upper end of the inner handle 16. In similar fashion the other hub 62, namely the outside hub, also has a generally square or non-round opening 56 formed coaxially therein for accommodating the compatible generally square protruding hub 57 associated with the upper end of the outer handle 18.

Each of the rotary hubs 61 and 62 has a generally identical pair of cam arms 58 and 59 protruding radially outwardly in circumferentially spaced relationship, the cam arms protruding generally downwardly so as to define an angular space or gap therebetween.

The outer rotary hub 62 also has a locking lug 60 which projects radially upwardly therefrom, generally diametrically opposite from the pair of cam lugs 58-59. This locking lug 60 has a small slot 64 opening radially inwardly from the outer edge thereof, which slot 64 opens inwardly generally along a radial line which intersects the rotational axis 63.

The rotary hubs 61 and 62, when the latching arrangement is in a position wherein the handles 16 and 18 are in their normal neutral end positions (i.e., not displaced by an operator), are coaxially aligned one behind the other as illustrated in FIGS. 5 and 6. In this latter position, the cam legs 58 of hubs 61 and 62 effectively abut against a stop pin 65 which is fixed to the housing so as to prevent the rotary hubs from rotating in a counterclockwise direction from the positions illustrated by FIGS. 5-7. A further stop 66 is fixed to the housing and positioned for cooperation with the other cam legs 59 to limit the rotational displacement (clockwise displacement in FIGS. 5 and 6) of either or both rotary hubs 61 and 62 to an angle typically less than 45°.

The cam arms 58-59 associated with the rotary hubs 61 and 62 cooperate with an activating linkage which includes an actuator lever 67 disposed adjacent the bottom of the housing 31 and which, at one end, is pivotally supported by a pivot axis 68 which extends transversely relative to the door. This actuator lever 67, spaced from the hinge 68, has a cam follower 71 thereon which is of a width such that it can simultaneously cooperate with the cam legs 58-59 associated with each of the rotary hubs 61 and 62, whereby clockwise rotation of hub 61 or 62 in FIG. 5 causes the cam arm 58 to react against the cam follower 71 and effect downward (counterclockwise) swinging of the actuator lever 67.

Actuator lever 67 is provided with a finger part 72 at the outer free end thereof, which finger part protrudes into a vertically elongate slot 69 formed in the control slide 34. The lower end of this slot 69 defines a shoulder 73 which reacts with the finger part 72, when the mechanism is in the latching position shown in FIG. 6, so that downward (i.e. counterclockwise) swinging of actuator arm 67 hence effects downward vertical displacement of slide member 34 so as to effect retraction (i.e. unlocking) of the latch bolt 24.

The actuator lever 67 is normally urged upwardly into a position wherein the cam follower 71 is engaged in the angular recess between the cam arms 58 and 59, as shown in FIGS. 5 and 6, by a suitable spring, such as the spring arm 74 which urges the cam follower 71 toward a position of engagement with the rotary hubs 61-62.

The latching arrangement 22, as illustrated by FIGS. 5-6, includes a latching linkage 76, which includes a rotary lock activator member 77 and a rotary latch member 78.

Figure 8:
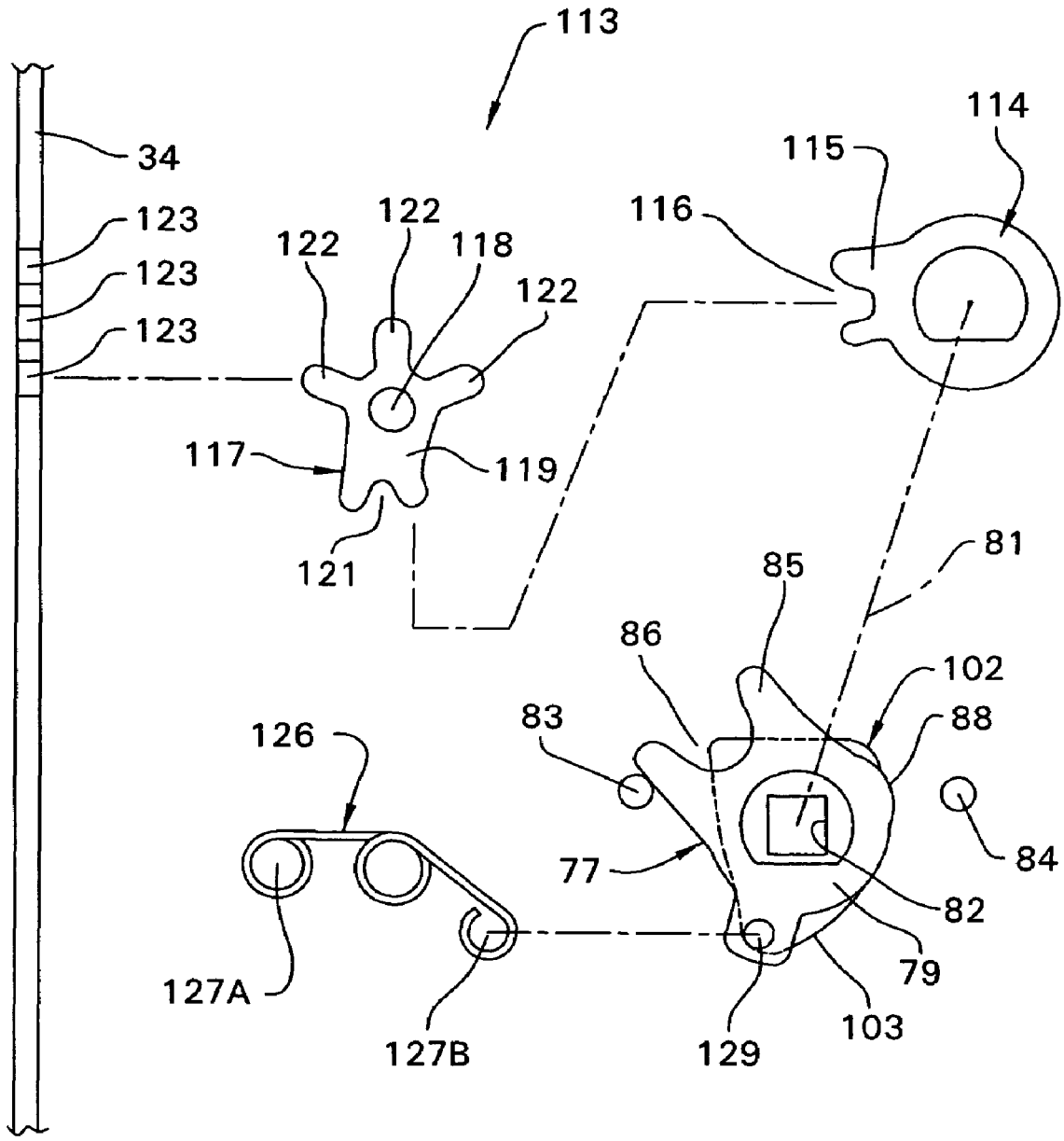
FIG. 8 is an exploded diagrammatic view which illustrates the rotary locking hub assembly and the motion transmitting linkage which connects with the vertically movable latch bolt slide.

The rotary lock activator member 77, as illustrated in FIG. 8, includes an annular hub 79 which defines a rotational axis 81 which extends transverse with respect to the door. A bore or opening 82, normally non-circular and preferably square, extends coaxially through the hub. A pair of stops 83 and 84 are fixedly secured to the housing and positioned generally on diametrically opposite sides of the rotary activator member 77 for limiting the rotational movement thereof between a release or unlatched position as shown in FIG. 5, and a locking or latching position as shown in FIGS. 6 and 8. These stops are normally positioned to allow about a 90° angle of rotation of the activator member 77.

The rotary lock activator member 77 includes an arm 85 protruding radially outwardly therefrom, the latter having a slot 86 opening generally radially inwardly from the free end thereof, whereby the arm has a generally bifurcated or fork-like construction as it protrudes radially outwardly. This arm 85 is configured and positioned so as to cooperate with an eccentric or crank 87 associated with the lock cylinder 19. The eccentric 87 is generally rotatable about an axis 89 defined by the lock cylinder 19 so that when the lock cylinder is manually activated by a key in a conventional manner in either the locking or unlocking direction, this causes a swinging movement of the lock eccentric 87 so that it moves into the slot 86 for engagement with the arm 85 to effect swinging of the rotary lock activator member 77 between the positions indicated in FIGS. 5 and 6. The construction of the lock cylinder 19 and eccentric 87 associated therewith is conventional, and further description thereof is believed unnecessary.

The lock activator is also drivingly connected to the rotatable thumb turn 17. In the preferred embodiment the thumb turn 17 has a hub or shaft which protrudes into the opening 82 of hub 79 so as to directly nonrotatably couple thumb turn 47 to the member 77.

Considering now the latch member 78 (FIGS. 5 and 6), it is supported on a generally central pivot 91 which again extends transversely with respect to the door. The latch member has a first elongate arm 92 which protrudes from pivot 91 in a generally downward direction. The arm 92 has a transverse hook or latch part 93 on the lower free end thereof, the latter being adapted to project into an opening or slot 94 formed in the slide member 33 when the mechanism is in the released position shown by FIG. 5. When the latch arrangement is in the latching or locking position of FIG. 6, however, the latch tab 93 merely abuts the side of the slide member 33.

Latch member 78 also includes a second elongated arm 95 which protrudes away from axis 91 in a direction generally toward the rotary activator member 77, whereby arms 92 and 95 in the illustrated embodiment define a generally L-shaped configuration. The protruding arm 95, adjacent the free end thereof, defines a generally flat cam part 96 which is adapted to react with a cam ramp or profile 88 defined on the exterior of the rotary hub 79. A spring 98, which at one end bears against an anchor pin 99, acts against a third arm or protrusion 97 associated with the latch member 78 so that the spring 98 normally urges the latch member 77 toward a position where cam flat 96 engages the cam 88 on hub 79, and latch part 93 protrudes into slot 94. This urging of the latch member 78 by the spring 98 is clockwise in FIGS. 5 and 6.

When the latching arrangement is in the unlatched position illustrated by FIG. 5, spring 98 urges the latch member 78 clockwise so that latch tab 93 is engaged within the slot 94 of slide 33, whereby both slides 33 and 34 are positively held in the retracted non-latching position of the mechanism. At the same time the cam part 96 of arm 95 is urged to a position wherein it is disposed closely adjacent the periphery of the rotary activator member 77, the latter being in its unlocked position shown in FIG. 5. If the activator member 77 is rotated toward the locking position of FIG. 6, however, then the cam ramp 88 defined on the periphery of the hub engages the cam part 96 and swings the latch member 78 counterclockwise in opposition to the urging of spring 98, thereby effecting withdrawal of latch tab 93 from slot 94, and thereby releasing the slides 33-34 so that they are spring-urged outwardly into the extended or latching position, as discussed in greater detail hereinafter.

The latching arrangement 22 also includes a locking linkage 101 (FIG. 7). The locking linkage 101 includes a rotary lock cam 102 which is mounted coaxially adjacent and nonrotatably coupled to the rotary lock activator member 77 (FIG. 8) for simultaneous rotation with the lock activator 77 about the axis 81. The cam member 102 has a ramp-like cam profile 103 associated with a lower edge thereof, and the latter cam profile is positioned for engagement with an opposed cam profile 104 defined on an upper edge of a slide plate 105. This latter plate is vertically slidably guided and supported within the housing 31 generally vertically between the cam plate 102 and the outside rotary hub 62. The slide plate 105 cooperates with suitable guides associated with the housing so that the slide plate can move solely vertically generally along a line of movement 106 which perpendicularly intersects the rotational axes 81 and 63. The slide plate 105 has a locking projection 107 protruding outwardly therefrom, the latter being positioned generally along the line of movement 106. This projection 107 is adapted to protrude into the slot 64 associated with the rotary hub 62 when the slide plate 105 is displaced downwardly by the cam edge 103 into a locking position as shown in FIG. 6. A spring 109 reacts against an arm or flange 108 provided on the slide plate 105 so as to normally urge the slide plate 105 upwardly into engagement with the cam member 102. When the cam member 102 is rotated into the unlatching position corresponding to the positioning of the mechanism in FIG. 5, the spring 109 hence normally maintains the slide plate 105 in an uppermost position wherein the lock projection 107 is disengaged from the slot 64 of the rotary hub 62.

Lastly, the latching arrangement 22 also includes a motion transmitting linkage 113 (FIGS. 5, 6 and 8) coupled between the slide member 34 and the rotary activator member 77 to ensure that both are either in a locking position or an unlocking position at the same time.

More specifically, the motion transmitting linkage 113 includes a coupling member 114 which is rotatably mounted coaxially with the rotary activator member 77 on the axis 81, with this coupling member 114 being nonrotatable relative to the activator member 77 so that the members 77 and 114 always rotate synchronously. The coupling member 114 has an arm part 115 protruding radially outwardly therefrom, the latter having a slot 116 opening radially inwardly thereof so that the arm 115 has a bifurcated or fork-like configuration as it protrudes radially outwardly.

The motion transmitting linkage 113 also includes a coupling member 117, specifically a rotary toothed (i.e. gear) member 117 which is supported for rotation on a generally center pivot 118 which defines a pivot axis extending transversely in generally parallel relationship to the pivot axis 81. The coupling member 117 also has a bifurcated or fork-shaped arm 119 projecting radially outwardly therefrom and defining an inwardly opening slot 121 therein. Coupling member 117 also has a plurality of circumferentially spaced teeth 122, three such teeth in the illustrated embodiment, the latter being disposed generally on a side of the coupling member which is diametrically opposite from that of the fork-shaped arm 119.

The coupling member 117, as illustrated by FIGS. 5-6, is supported by its pivot 118 closely adjacent one side of the slide member 34 such that the teeth 122 are adapted to cooperate with a series of slots or openings 123 formed in the slide member 34, which slots 123 define a linear gear rack which cooperates with the teeth 122 of coupling member 117.

The motion transmitting linkage 113 has a generally V-shaped over-center spring 126 so as to urge the motion transmitting linkage 113 into the end positions illustrated by FIGS. 5 and 6. More specifically, this spring 126 has one end 127A thereof anchored to the housing by an anchor pin 128. The other end 127B of spring 126 is anchored to a pin 129 which is fixed to the rotary lock activator member 77 such that the pin 129 is spaced radially from the rotational axis 81.

The spring 127 exerts a biasing force for maintaining the rotary lock activator member 77 in the unlatched position shown in FIG. 5, but likewise also exerts a biasing force tending to maintain the rotary lock activator member 77 in the latching position of FIG. 6, with the configuration of the spring and the disposition of its end connections being such that the spring effectively creates an over-center effect so as to exert a rotational biasing force against the rotary lock activator 77 in opposite directions, depending upon its end position.

During movement of the rotary activator 77 between the unlatched and latching positions shown by FIGS. 5 and 6, respectively, the coupling member 114 moves synchronously with the actuator member 77 into the position shown by FIG. 6, and the release of the slide 34 causes rotation of the coupling member 117 so that it moves into the position shown in FIG. 6. During this simultaneous but counter-rotational movement of the coupling members 114 and 117, the opposed forked arms 115 and 119 engage one another during part of the rotational movement thereof.

For return movement, however, when slide 34 is moved or retracted inwardly toward the unlatched position shown by FIG. 5, the teeth 122 react with gear rack 123 so that coupling member 117 rotates counterclockwise in FIG. 6, causing the forked arm 119 thereof to engage the forked arm 115 of coupling member 114, thereby positively rotatably driving the coupling member 114 (and also the rotary lock activator member 77 and cam 102) clockwise about axis 81 back toward the unlocked position of FIG. 5. As these latter members rotate clockwise about axis 81 toward the position shown in FIG. 5, however, the spring 127 passes through an over-center position so that the spring assists in positively rotatably driving these members clockwise into the unlatched position shown by FIG. 5.

With respect to the interior handle 16, it normally will include a spring connection cooperating between the handle and the door, such as a conventional torsion spring, whereby the inner handle 16 is hence always urged generally into the position shown by solid lines in FIG. 2, in which position the rotary hub 61 associated with handle 16 hence abuts against the stop 65, thereby preventing the handle 16 from being rotated away from this position in a direction towards the edge 23 of the door (i.e., in a clockwise direction in FIG. 2). When the handle 16 is manually moved (i.e. swung) in the opening direction of the door, such as to the position indicated in dotted lines in FIG. 2, the handle 16 will be automatically spring-returned to the normal solid line position when the manual opening force applied to the handle 16 is relieved.

The outer handle 18 is preferably of identical construction in that it will swing away from the normal position, such as only in an opening direction away from the door edge 23, as indicated by dotted lines in FIG. 1, and will be automatically returned to its upright position by an internal spring when the manual opening force is relieved from the handle.

Handles having internal springs for connection to the door for assisting automatic return of the handle to a predefined position are well known, whereby further description thereof is believed unnecessary.

The operation of the sliding door 12 incorporating thereon the improved latching arrangement 22 of this invention will now be briefly described to ensure a more complete understanding thereof.

Whenever the door 12 is in a nonlatched position, whether the door is opened or closed, the latch mechanism 22 is maintained in the position illustrated by FIG. 5, and the latch bolt (for example the upper latch bolt 24) is retracted downwardly generally into the interior of the door.

Assuming the door is in an open position, then a person can close the door by engaging either inner handle 16 or outer handle 18, both of which are in the upright end position, and by exerting a horizontal pulling force on the handle in the direction of the door edge 23, the door can be moved into a closed position. During this closing movement, the handle does not pivot relative to the door, and the latching mechanism remains in the unlatched position shown in FIG. 5.

With the door closed, if a person wishes to engage the latch from adjacent the inside of the door, this engagement can be accomplished only by manually engaging and rotating the thumb turn 17, the hub of which is engaged in the opening 82 of the rotary lock activator member 77. Rotation of thumb turn 17 causes the cluster of rotary elements on axis 81, namely rotary lock activator member 77, cam 102 and coupling member 114, to all rotate through a small angle (approximately 90°) from the unlatching position of FIG. 5 to the latching position of FIG. 6. During rotation of the rotary lock activator 77, the cam ramp 88 thereon engages the cam part 96 and depresses latch arm 97 downwardly in a counterclockwise direction about hinge 91 in opposition to the urging of spring 98. This withdraws latch part 93 from opening 94, hence releasing the slide member 33. The springs 47 and 47A acting against the respective slides 34 and 33, and the motion control mechanism 37 which couples and synchronizes the opposed motion of the slide members, permits the slides 34 and 33 to be respectively vertically displaced upwardly and downwardly, causing the attachment 36 and the latching bolt 24 connected thereto to be vertically displaced upwardly so that the upper end part 25 of latch bolt 24 engages the stationary retainer 26. This hence locks the door and prevents the door from being horizontally slidably moved in the opening direction.

Simultaneous with the above, the rotation of the cam 102 causes the slide 105 to be moved downwardly so that locking projection 107 enters into slot 64, thereby locking the outer rotary hub 62 so that the latter can not rotate. This hence also effectively locks the outer handle 18 so that the door can not be unlocked or opened from the outer side.

With the closed door having been locked from the inside thereof, the unlocking of the door from the inside now occurs solely through movement of the inner handle 16. This latter handle will normally be maintained in the neutral end position indicated by solid lines in FIG. 2. To unlock and open the door, the person engages solely the handle 16 and exerts a generally horizontally directed force against the handle 16 in the opening direction (i.e. away from the door edge 23), causing the handle 16 to swing through its limited motion extent into the position indicated by dotted lines in FIG. 2. This swinging of handle 16 causes the inner rotary hub 61 to rotate (clockwise in FIGS. 6 and 7), while at the same time the outer rotary hub 62 is locked and can not rotate. Rotation of inner hub 61 causes the cam arm 58 to react against the cam follower 71 so that actuating lever 67 is swung downwardly (counterclockwise in FIG. 6) against the urging of spring 74. As the actuating lever 67 initiates its downward swinging movement, the finger part 72 thereof engages the shoulder 73 inasmuch as the slide 34 is in its raised extended (i.e. latched) position. The continued driving engagement of the cam arm 58 against cam follower 71 causes the activating lever 67 to swing downwardly and hence effectively pulls the slide member 34 downwardly back to its initial unlatching position shown in FIG. 5. During this movement the gear rack 123 reacts with the coupling member 117 which rotates and in turn reacts with the other coupling member 114, thereby rotating the lock activator 77 and cam 102 back to the unlatched position of FIG. 5. This hence enables the spring 98 to again urge latch member 78 to swing clockwise in FIG. 5 so that the latch tab 93 is aligned with and hence enters into the opening 94 to latchingly hold the slides 33-34 in the retracted positions. At the same time the rotation of cam 102 allows the slide 105 to slide upwardly due to the urging of spring 109, thereby disengaging the lock projection 107 from the outer rotary hub 62, thereby restoring the function of the outer handle for permitting opening of the door.

When desired, the closed door can also be locked from the outside by inserting a key 21A into the lock cylinder 19 and effecting rotation thereof, which in turn causes the eccentric 87 to rotate and engage the rotary lock activator 77 so as to move the latter from the unlatched position of FIG. 5 into the latched position of FIG. 6, whereupon the latch arrangement is activated and the lock bolt 24 extended in generally the same manner as described above.

To unlock the closed door from the outside, the key is inserted into the lock cylinder 19 and rotated, whereby eccentric 87 rotates the lock activator 77 from the latched position of FIG. 6 back to the unlatched position of FIG. 5. This also allows the spring 109 to urge the lock slide 105 upwardly so that lock projection 107 disengages the outer rotary hub 62. The return rotation of activator 77, however, is not capable of retracting the lock bolt 24. Thus, to complete the unlocking and opening of the door, the exterior handle 18 is manually engaged and is manually swung in the opening direction. This causes outer rotary hub 62 to rotate and effect downward camming of lever 67, which in turn pulls control slide 34 downward so as to retract the lock bolt 24. Continued force against the outer handle 18 in the opening direction then effects opening of the door.

It will be appreciated that when the door is in a closed but nonlatched position, the door can be opened by manually engaging the exterior handle 18 and applying a horizontal force thereto in the opening direction. This will cause the handle 18 to angularly move through a small extent (as indicated by dotted lines in FIG. 1), and this is accompanied by rotation of the outer rotary hub 62 in a clockwise direction away from the stop 65 as illustrated in FIG. 7, and this in turn causes a downward camming of the activating lever 67 against the urging of spring 74. Since the latch mechanism is in the unlatched position of FIG. 5, however, the slide member 34 is already retracted, and hence the finger part 72 of activating lever 67 merely moves downwardly within the extent of the slot 69 and hence has no effect on the latching mechanism. After the door has been opened and the operator force removed from the handle 18, however, the spring 74 (assisted by the internal spring in the handle) will cause the activating lever 67 to be moved upwardly which cams against the cam arms of the outer rotary hub 62, thereby causing the rotary hub 62 and the outer handle 18 to be returned to their normal end position as indicated by solid lines in FIG. 1. While this swinging movement of the outer handle in the opening direction of the door hence does not effect any movement of the latching mechanism, nevertheless such movement of the handle is desired since it provides a signal to the operator that the door is unlocked and can be opened, in contrast to the situation when the handle is not movable so as to indicate that the door is locked.

In the description of the mechanism presented above, the reference to the various pivot shafts or axes extending transverse to the door, such as the pivots 63, 81, 91, 39, 68 and 118, will be understood to mean that these pivot axes are generally parallel and horizontal, and extend generally perpendicular with respect to the side faces of the door.

With the present invention, the positioning of the handles, and particularly the inner handle 16, and their cooperation with the latching mechanism, is such that the angular movement of the handle between the extreme or end positions is preferably a small angle, preferably less than 45°, and more preferably in the neighborhood of about 30°. In addition, the handle is oriented so that the elongate direction thereof is dominantly vertical, such as the vertical orientation of the handles in the normal end positions illustrated by FIGS. 1 and 2, since the handle hence has a dominant vertical orientation throughout the full stroke of movement between its end positions, whereby application of a substantially horizontally-oriented pushing force against the inner handle 16 in the opening direction can readily effect unlocking and opening of the sliding door by means of a substantially single and substantially horizontally-directed force and motion. The mechanism hence can be activated and unlocked from the inside of the door without requiring the operator to carry out either multiple diverse manipulations or positive grasping of the handle.

While the present invention utilizes in a preferred embodiment thereof a handle having the properties as described above, it will also be recognized that other variations can be utilized, and in this regard reference is made to numerous other variations as disclosed in aforementioned copending application Ser. No. 10/424,260, the entire disclosure of which is incorporated herein by reference.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An openable and closable door arrangement for a doorway, comprising:

an upright sliding door positioned for generally solely horizontal movement between opened and closed positions relative to the doorway;

an activating handle having a lever and being mounted on one side of the door for controlling opening and closing movement thereof, said activating handle being pivotally supported on said door for swinging movement about a substantially horizontal pivot axis which extends transverse to a face of the door, said activating handle having a vertical orientation and being angularly swingably moveable through an angular extent;

a locking mechanism supported on said door and including a vertically elongate locking bolt supported on the door for vertical sliding movement, said locking bolt having an end portion which projects outwardly beyond the door for engagement with an adjacent stationary structure of the doorway when the door is in the closed position and the locking bolt is in a locking position;

a manually accessible and manually moveable actuator disposed adjacent said one side of the door and interconnected to said locking mechanism to prevent actuation of the locking bolt;

a motion transfer mechanism connected between said activating handle and said locking mechanism such that an application of a manually-applied generally sidewardly-directed horizontally oriented opening force solely against said activating handle swings the activating handle from said vertical orientation into an end position to cause retraction of the locking bolt into an unlocking position with continued application of said opening force to said activating handle effecting opening of the sliding door;

wherein application of a closing force opposite to said opening force against the activating handle by a person positioned adjacent said one side of said door closes but does not lock said sliding door when said sliding door is in said closed position; said locking mechanism includes a slide mechanism supported for vertical slidable displacement between locking and unlocking positions, said slide mechanism being connected to said locking bolt, and a spring interconnected to the slide mechanism for urging the locking bolt toward the locking position;

said locking mechanism including a rotary lock member supported for pivoting movement between locked and unlocked positions and drivingly interconnected to said manually moveable actuator;

said locking mechanism including a latch movable between latched and unlatched position and cooperating between the rotary lock member and the slide mechanism to lock the slide mechanism and said locking bolt in their unlocking positions when the rotary lock member is in its unlocked position; and said locking mechanism including a motion transfer linkage operatively interconnected between said slide mechanism and said rotary lock member which automatically returns said rotary lock member to said unlocked position whenever said slide mechanism is moved from its locking position to its unlocking position.

2. A door arrangement according to claim 1, wherein the motion transfer linkage includes a lost-motion mechanism.

3. A door arrangement according to claim 1, including a key-activated lock cylinder mounted on said door and cooperating with said rotary lock member, said key-activated cylinder being accessible from the other side of said door.

4. A door arrangement according to claim 3, wherein said key-activated cylinder cooperates with the rotary lock member through a lost-motion connection, and wherein the manually moveable actuator is directly drivingly engaged with said rotary lock member.

5. A door arrangement according to claim 1, wherein said activating handle is dominantly vertically oriented.

6. A door arrangement according to claim 1, wherein the motion transfer mechanism includes a rotary hub having a cam profile, said rotary hub connected to and rotatable with the activating handle, and the motion transfer mechanism further includes an activating lever having a cam part cooperating with the cam profile on the rotary hub and having a further part engaged with the slide mechanism for retracting the slide mechanism from the locking position into the unlocking position.

7. In combination, an openable and closable upright sliding door having first and second side faces defined on opposite sides thereof, first and second activating handles mounted on said door adjacent solely said first and second side faces, respectively, for controlling opening and closing movement of said door, a locking bolt supported on the door for vertical sliding movement between an extended locking position wherein an end portion of the bolt projects outwardly of the door and a retracted unlocking position wherein the end portion is retracted inwardly of the door, a manually accessible and rotatable lock actuator mounted on said door and accessible from said first side face of said door, and a latch controlling mechanism mounted inside of said door adjacent an upright edge thereof and interconnected to said first handle, said lock actuator and said locking bolt for controlling the position of the locking bolt, said latch controlling mechanism comprising:

a housing;

a rotary lock control member swingably supported within said housing for angular movement between unlocking and locking positions, said rotary lock control member being rotatably interconnected to said manually rotatable lock actuator;

a slide mechanism slidably supported in said housing for movement between locking and unlocking positions, said slide mechanism being connected to said locking bolt to lock controlling movement thereof;

a latch mechanism moveable between latched and unlatched positions and cooperating between said slide mechanism and said rotary lock control member for the slide mechanism and said locking bolt in their unlocking positions when the rotary lock control member is in its unlocking position; and a motion coupling arrangement cooperating between said slide mechanism and said rotary lock control member which automatically returns the rotary lock control member from its locking position to its unlocking position in response to movement of the slide mechanism from its locking position to its unlocking position.

8. A combination according to claim 7, wherein the motion coupling arrangement includes a lost-motion coupling cooperating between said slide mechanism and said rotary lock control member.

9. A combination according to claim 7, including a motion transmitting mechanism connected between the first activating handle and the slide mechanism for retracting the slide mechanism and the locking bolt into their unlocking positions in response to manual displacement of the first activating handle in a door-opening direction.

* * * * *

UNITED STATES PATENT AND TRADEMARK OFFICE

CERTIFICATE OF CORRECTION

PATENT NO. : 7,377,076 B2
APPLICATION NO. : 10/966344
DATED : May 27, 2008
INVENTOR(S) : Nathaniel S. Shedd It is certified that error appears in the above-identified patent and that said Letters Patent is hereby corrected as shown below:

Column 14, line 8; change "said locking bolt to lock controlling movement" to --said locking bolt for controlling movement--

Column 14, line 12; change "for the slide mechanism" to --to lock the slide mechanism--

Signed and Sealed this

Eleventh Day of November, 2008

JON W. DUDAS
*Director of the United States Patent and Trademark Office*